US006733380B1

(12) United States Patent
Kohls et al.

(10) Patent No.: US 6,733,380 B1
(45) Date of Patent: May 11, 2004

(54) COIN WRAPPING ATTACHMENTS FOR A COIN SORTER

(75) Inventors: Cory A. Kohls, Oconomowoc, WI (US); Myron Spoehr, Lake Mills, WI (US); Thomas P. Adams, Oconomowoc, WI (US)

(73) Assignee: De La Rue Cash Systems, Inc., Lisle, IL (US)

( * ) Notice: Subject to any disclaimer, the term of this patent is extended or adjusted under 35 U.S.C. 154(b) by 16 days.

(21) Appl. No.: 09/653,396

(22) Filed: Sep. 1, 2000

(51) Int. Cl.[7] ..... G07D 9/04

(52) U.S. Cl. ..... 453/59; 453/31; 53/212; 53/254

(58) Field of Search ..... 453/59, 31; 53/212, 53/254, 523; 403/321, 322.1, 322.3, 324–326, 328

(56) References Cited

U.S. PATENT DOCUMENTS

| | | | | | |
|---|---|---|---|---|---|
| 1,491,522 | A | * | 4/1924 | Downey | 453/62 |
| 1,673,709 | A | * | 6/1928 | Reid et al. | 453/12 |
| 1,710,353 | A | | 4/1929 | Donnellan | |
| 1,819,235 | A | * | 8/1931 | Donnellan | 453/31 |
| 1,908,565 | A | * | 5/1933 | Smith | 453/31 |
| 1,919,963 | A | * | 7/1933 | Smith | 53/254 |
| 2,289,002 | A | * | 7/1942 | Flemming et al. | 453/5 |
| 2,620,109 | A | * | 12/1952 | Smathers | 53/254 |
| 2,749,001 | A | * | 6/1956 | Reis | 141/183 |
| 2,750,949 | A | * | 6/1956 | Kulo et al. | 453/34 |
| 3,710,544 | A | | 1/1973 | Lamming | |
| 3,843,203 | A | | 10/1974 | Golland et al. | |
| 4,286,703 | A | | 9/1981 | Schuller et al. | |
| 4,495,959 | A | * | 1/1985 | Farber | 453/9 |
| 4,593,709 | A | * | 6/1986 | Duplessy | 453/9 |
| 5,096,236 | A | * | 3/1992 | Thony | 292/32 |
| 5,295,899 | A | | 3/1994 | Adams et al. | |
| 5,297,598 | A | | 3/1994 | Rasmussen | |
| 5,358,290 | A | * | 10/1994 | Fleet et al. | 285/7 |
| 5,433,419 | A | * | 7/1995 | Murakami | 156/166 |
| 5,507,379 | A | | 4/1996 | Mazur et al. | |
| 5,525,104 | A | | 6/1996 | Adams et al. | |
| 5,697,483 | A | | 12/1997 | Ishida et al. | |
| 5,782,571 | A | * | 7/1998 | Hufford et al. | 403/31 |
| 5,827,117 | A | | 10/1998 | Naas | |
| 5,902,178 | A | * | 5/1999 | Perkitny | 453/9 |
| 5,988,348 | A | | 11/1999 | Martin et al. | |
| 6,099,401 | A | * | 8/2000 | Perkitny | 453/9 |
| 6,196,913 | B1 | | 3/2001 | Geib et al. | |
| 2002/0144878 | A1 | | 10/2002 | Zimmermann | |

FOREIGN PATENT DOCUMENTS

| | | | | |
|---|---|---|---|---|
| EP | 1103929 | A2 * | 11/2000 | G07D/3/02 |
| EP | 1162578 | A2 * | 12/2001 | G07D/9/06 |

* cited by examiner

*Primary Examiner*—Donald P. Walsh
*Assistant Examiner*—Jeffrey Shapiro
(74) *Attorney, Agent, or Firm*—Quarles & Brady LLP

(57) ABSTRACT

A coin handling machine (10) having sorting openings from which respective denominations of coins are sorted prior to exiting the coin handling machine (10), includes a plurality of coin tubes (20) for holding coin wrappers (24) for respective denominations in a substantially upright position for receiving coins of respective denominations. The coin tubes (20) are mounted to one or more chutes (16) on the coin handling machine (10) for receiving coins of respective denominations that pass through the sorting openings. The coin tubes have portions (22, 23) with a shape for directing said coins into respective coin wrappers (24). Pivotable clips (26) are mounted in the lower end of the coin tubes (20) to support the lower end of the coin wrappers (24). Several specific embodiments having different types of attachment to coin handling machines are also disclosed.

8 Claims, 4 Drawing Sheets

FIG. 2
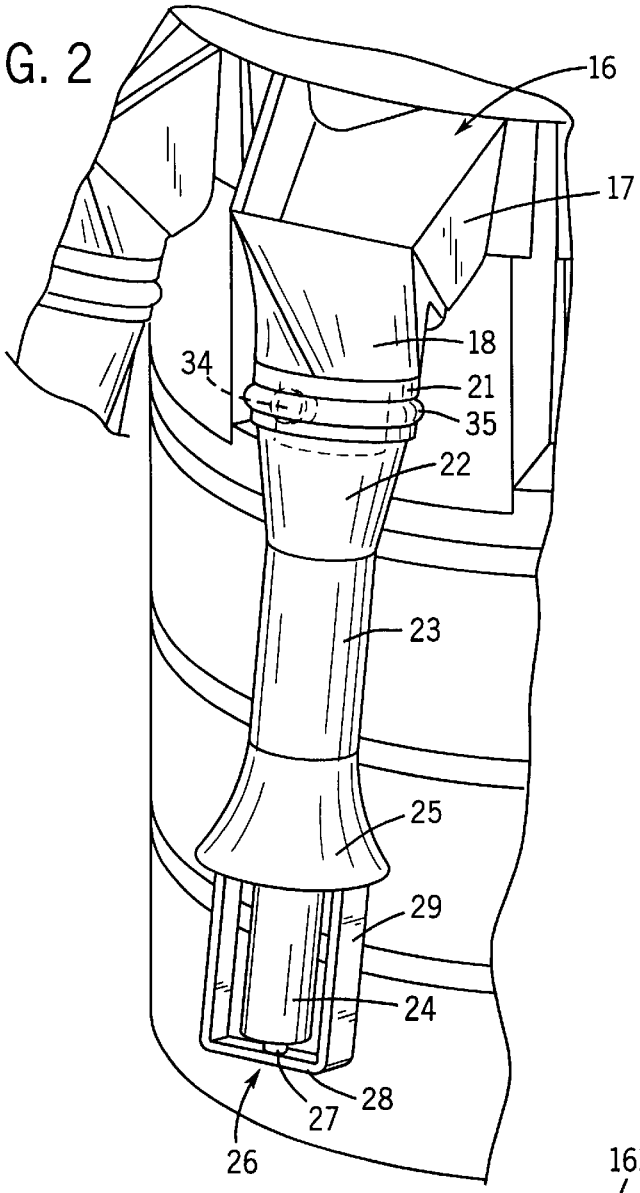
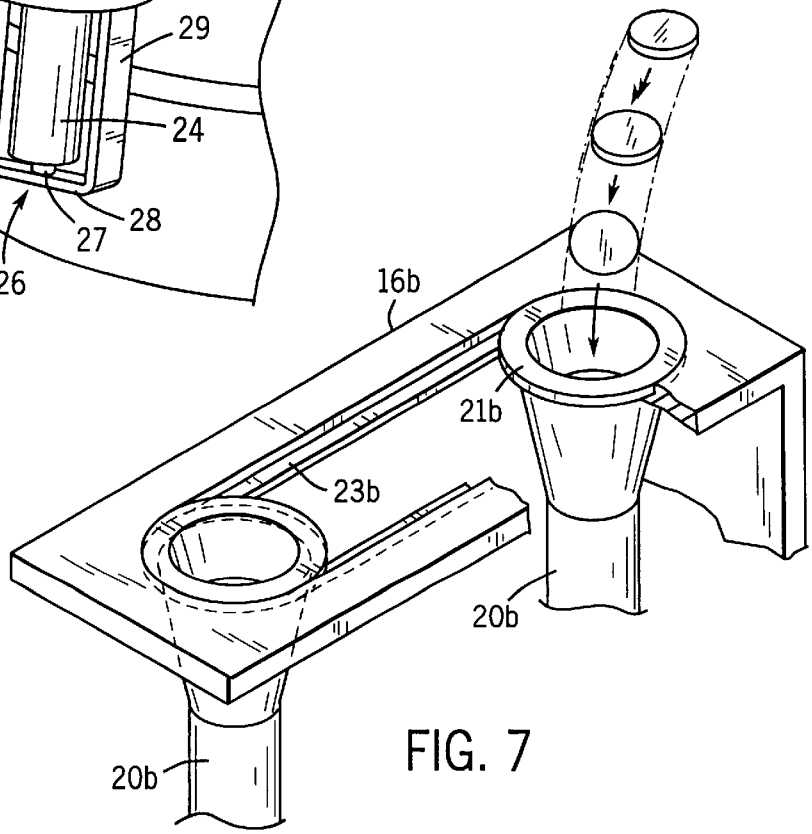
FIG. 7

COIN WRAPPING ATTACHMENTS FOR A COIN SORTER

TECHNICAL FIELD

The invention relates to coin processing equipment including coin sorters, coin wrapping equipment and coin dispensing equipment.

BACKGROUND ART

In the field of coin handling equipment, several types of machines are known. One type of machine is a coin wrapper in which coins of a single denomination are fed to a wrapping station for loading into coin wrappers. The term "coin wrappers" refers to the well known tubular paper sleeves, as well as flat sheet wrappers which are rolled, and wrappers of plastic material. The sleeves are filled with coins and then folded or crimped on the ends to keep the coins in the wrapper.

Another type of coin handling machine is a coin dispenser where change is dispensed to a coin tray for a customer. Yet another type of machine is a coin sorter for sorting coins by denomination from a mixed batch of coins. In this category are several types of sorters, including core sorters, rail sorters and rotary sorters, the last type of sorter being characterized by some type of rotatable coin drive disk that moves coins in a circular path to respective sorting grooves, sorting channels or sorting apertures, (collectively referred to herein as "sorting openings"). The sorting openings are sized for the respective denominations of coin, such as penny, nickel, dime, quarter, half and dollar in the United States, and for other denominations in countries outside the United States.

Coin tubes have been utilized in coin wrapping equipment for handling one denomination at a time. In coin sorters, it has been the practice to attach bags or box-like receptacles for collection of coins. There is a need, however, for a machine for sorting multiple denominations and then easily and conveniently feeding the coins to coin wrappers for several respective denominations.

SUMMARY OF THE INVENTION

The invention relates to a method and apparatus for sorting and collecting multiple denominations of coins into respective coin wrappers. The invention also relates to an individual coin tube attachment for holding a coin wrapper.

More particularly, the invention is practiced in a method that includes attaching a plurality of coin tubes to a coin sorting machine in positions in which a corresponding plurality of coin wrappers receive respective denominations of coins after said coins have been sorted, inserting the coin wrappers for respective denominations in said coin tubes, supporting the coin wrapper in each coin tube against falling out of a bottom end of each coin tube, sorting a plurality of denominations of coins in a single batch of coins by passing the coins through respective sorting openings within the sorting machine, and then removing the coin wrappers loaded with coins from the coin tubes.

The invention is also practiced in a coin handling machine having sorting openings from which respective denominations of coins are sorted, and having a plurality of coin tubes for positioning and supporting coin wrappers for respective denominations in a substantially upright position for receiving coins of respective denominations therein. The coin tubes each include a portion for mounting to said coin handling machine at a respective position for receiving coins of a respective denomination, and the coin tubes are shaped for directing the coins into respective coin wrappers.

The invention is applicable to coin handling machines having multiple sorting openings, and where one or more of coin tube attachments of the present invention are used.

A specific coin tube attachment preferably includes a U-shaped member pivotably mounted to a lower portion of a respective one of said plurality of coin tubes for supporting a lower end of a coin wrapper as coins are loaded into said coin wrapper. This member overcomes the problem of a user having to hold the coin wrapper in the tube as it is being filled. The U-shaped member also has a projection extending into the lower end of coin wrapper to hold the coins above a crimped end of the wrapper.

Various attachment structures can be used to attach the coin tubes to the coin chutes or other sorting opening exits on the coin handling machine.

Other objects and advantages of the invention, besides those discussed above, will be apparent to those of ordinary skill in the art from the description of the preferred embodiments which follow. In the description, reference is made to the accompanying drawings, which form a part hereof, and which illustrate examples of the invention. Such examples, however, are not exhaustive of the various embodiments of the invention, and therefore, reference is made to the claims which follow the description for determining the scope of the invention.

BRIEF DESCRIPTION OF THE DRAWINGS

FIG. 2 is an enlarged detail view of an individual attachment of FIG. 1;

FIG. 7 is a detail view with parts removed of a third embodiment of a coin sorter utilizing the present invention.

DETAILED DESCRIPTION OF THE PREFERRED EMBODIMENTS

Figure 1:
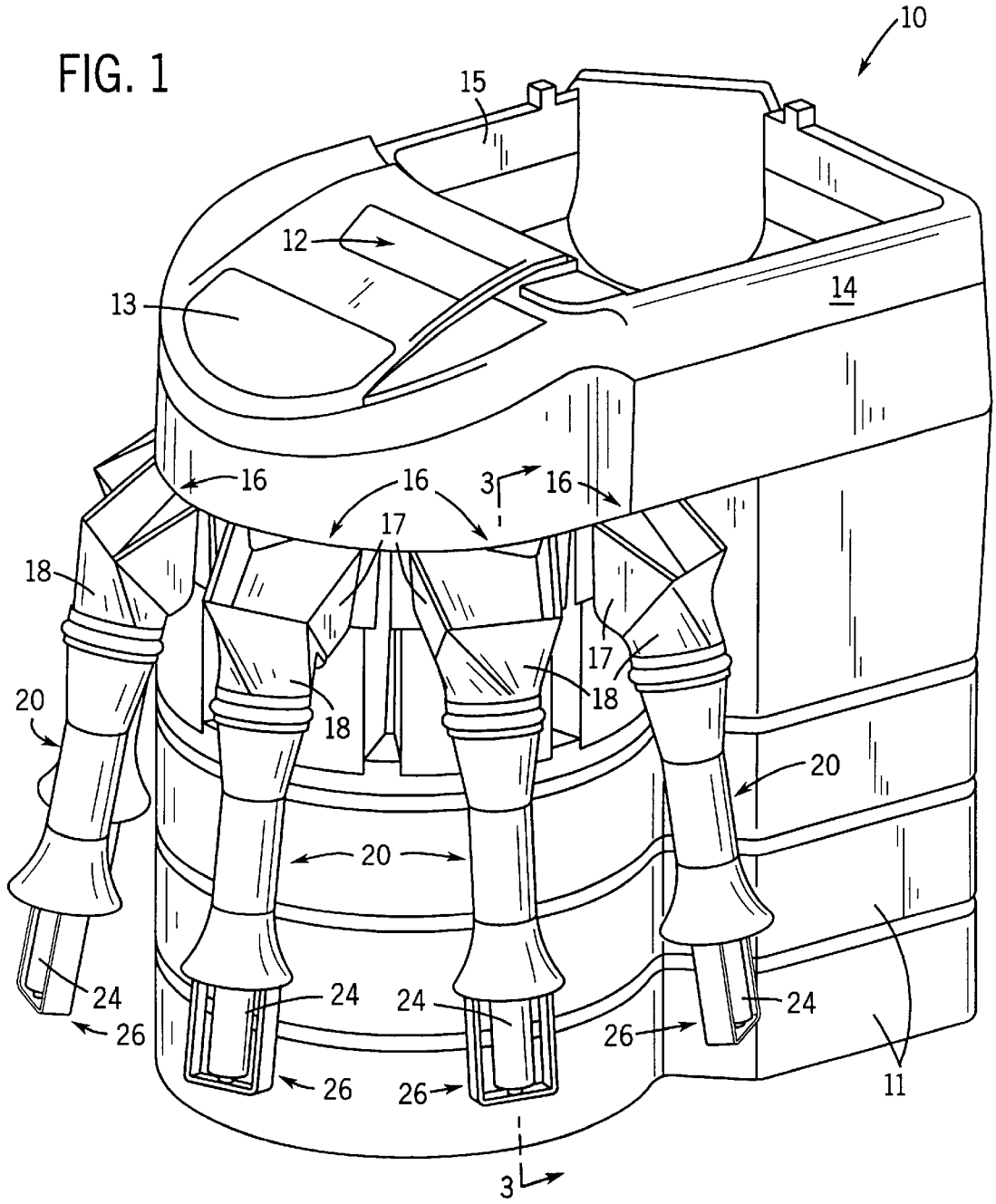
FIG. 1 is a perspective view of a first embodiment of a coin sorter with attachments that incorporate the present invention.

Referring to FIG. 1, a first embodiment of the present invention is a coin sorter 10 of a size that could be placed on a desktop, although in other embodiments the sorter could be a floor standing model. The coin sorter 10 is supported by one or more nested pedestals 11. The sorter 10 includes a visual display 12 for displaying count totals and a control panel 13 for entering commands and data to control the operation of the machine 10. An upper bezel 14 forms an opening into a hopper 15 for receiving a batch of coins of mixed denominations. These are sorted by a sorting mechanism of the type described in Adams et al., U.S. Pat. No. 5,295,899, issued Mar. 22, 1994, and Adams et al. U.S. Pat. No. 5,525,104, issued Jul. 11, 1996. The coins drop through respective sorting apertures in a sorting plate and are guided into coin chutes 16 for respective denominations, such as penny, nickel, dime, quarter, half, and dollar in the United States, and for other denominations in Europe, Canada and other countries.

Figure 3:
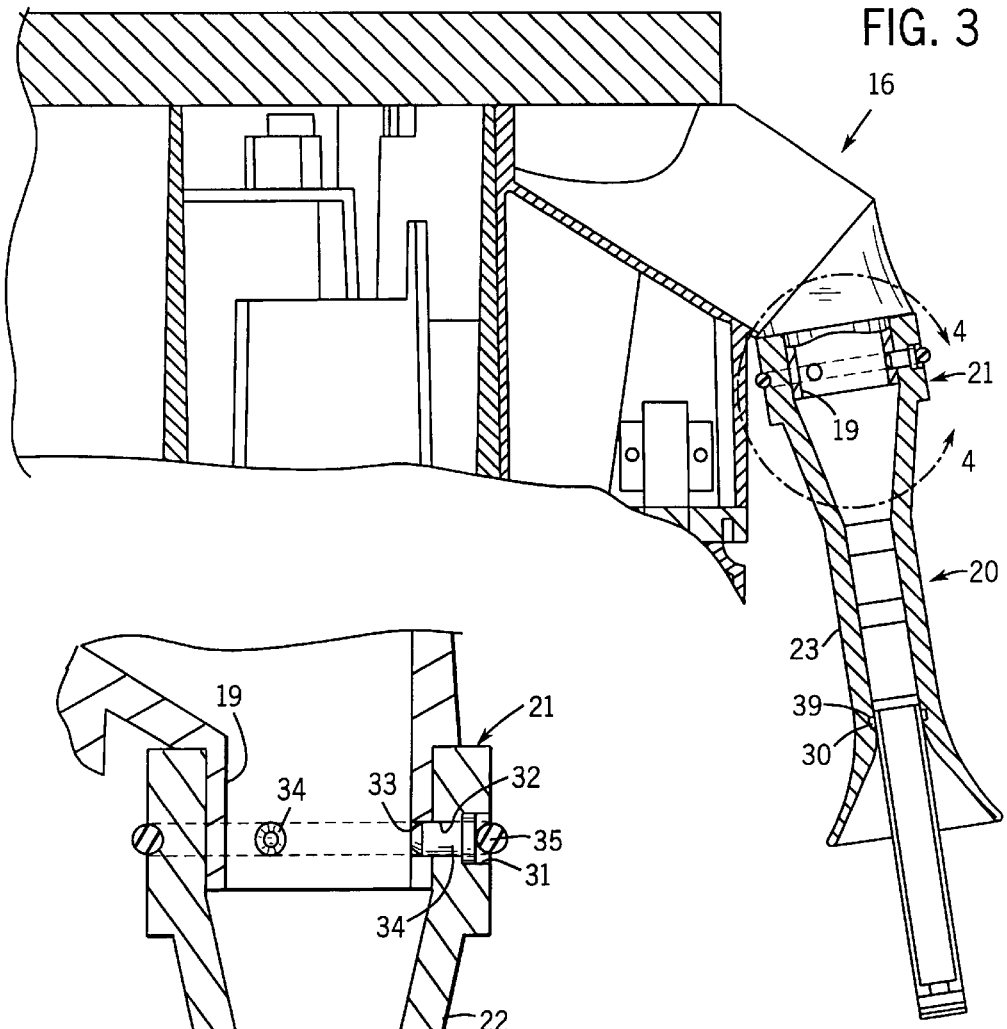
FIG. 3 is a sectional view taken in the plane indicated by line 3—3 in FIG. 1.
Figure 4:
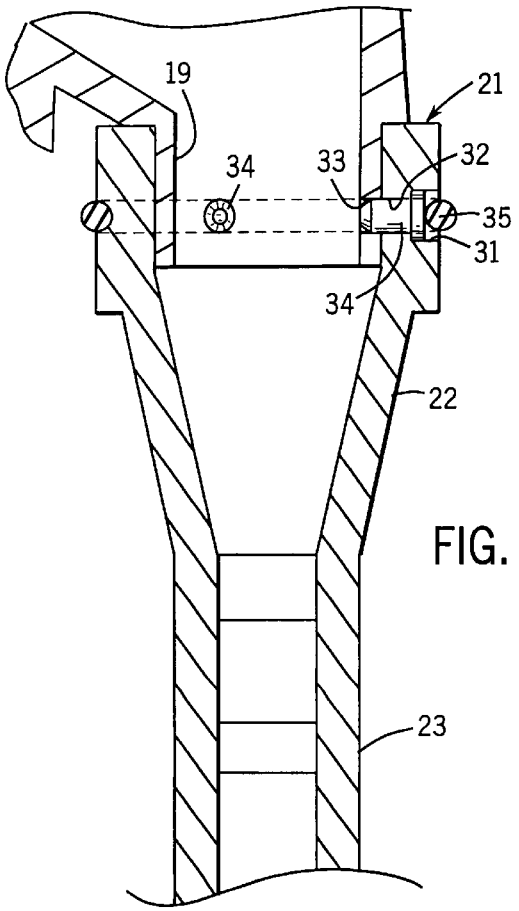
FIG. 4 is an enlarged detail view in section of a portion of the device of FIG. 3.

Each coin chute 16 is generally rectilinear with sides 17, and then a tapered portion 18, leading to a lower flange portion 19 which may be cylindrical (see FIGS. 3 and 4). A plurality of coin tubes 20 (FIG. 4) are attached to the respective coin chutes 16 for the purposes to be described. Each coin tube 20 (see FIG. 2) has a cylindrical end upper portion 21, a tapering cylindrical neck portion 22, a cylindrical holder portion 23 of constant diameter for receiving an upper end of a cylindrical paper or plastic coin wrapper 24 (FIGS. 1 and 2), and a bottom cylindrical flared portion 25 with an open end for allowing the coin wrapper 24 to extend below. The coin tube 20 supports the coin wrappers 24 in a substantially upright position, meaning either vertical or at some allowable angle not greater than forty-five degrees from vertical. The coin tubes 20 are preferably formed along a straight line central axis, but only required the portion of the coin tubes 20 holding the coin wrapper 24 need be straight. The coin tube 20 is preferably molded of plastic though other materials, including metal, could also be used.

A U-shaped clip or bail 26 is pivotably mounted inside the coin tube 16, as will be described, for the purpose of supporting the coin wrapper 24 and the coins when they are received in the coin wrapper 24. Each coin clip or bail 26 has a projection 27 on a lower cross member 28 (FIGS. 2, 3) for supporting the coins, while maintaining the shape of a crimped lower edge of the coin wrapper 24. The clip 22 is preferably made of metal, though other materials could be used.

Each clip or bail 26 has two spaced uprights 29 with projections 30 that are received in recesses 39 in an inside wall of the tube 20, so that the clip or bail 26 is pivotable. The clip or bail 26 could also be pivotably attached by rivets or other types of pivotable mounting.

The upper end 21 of the coin tube 20 can be attached in one of several ways. As seen in FIG. 4, the upper end 21 can be slipped over the lower flange 19 on the coin chute 16. A groove 31 is provided in the outside of the side wall of the upper end 21. In the groove 31, three apertures 32 are spaced at 120 degrees apart. The three apertures 32 extend through the upper end 21 for alignment with three corresponding apertures 33 in the lower flange 19. Three pins 34 with heads are inserted in the apertures 32, 33 to secure the upper end 21 of the coin tube 20 to the lower end 19 of the chute 16. An O-ring 35 of resilient, synthetic or natural rubber material is placed in the groove 31 to secure the pins 34 and prevent them from backing out of the apertures 32, 33.

Figure 5:
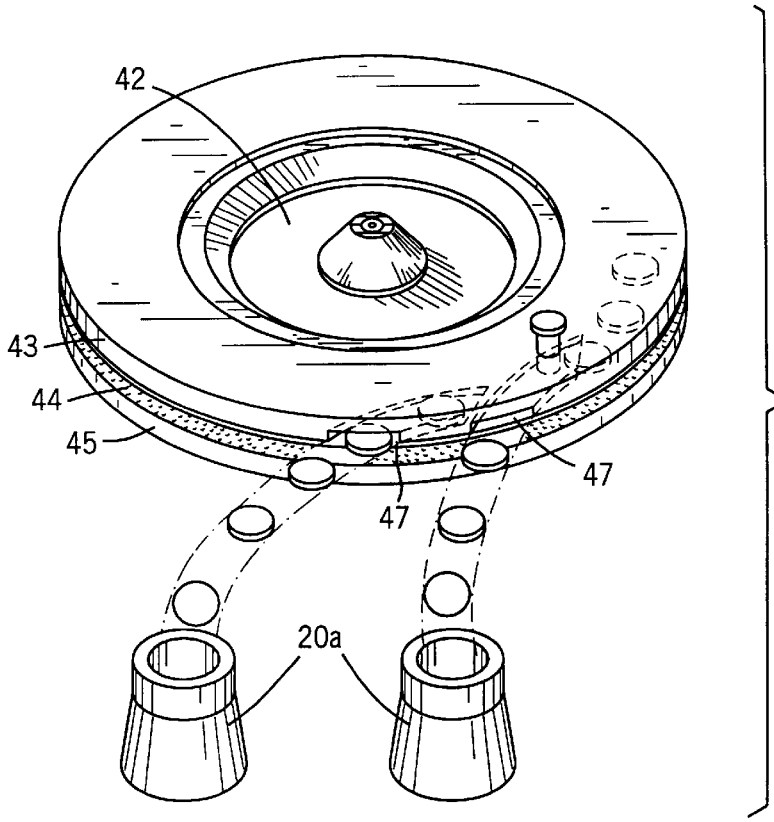
FIG. 5 is a perspective view with parts removed of a second embodiment of a coin sorter utilizing the present invention.
Figure 6:
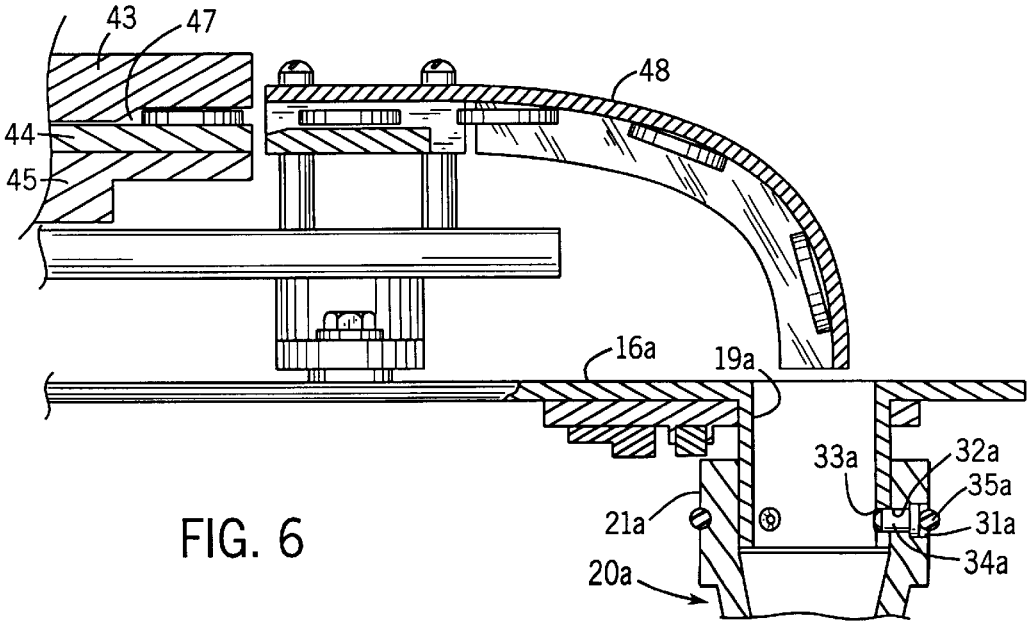
FIG. 6 is a detail view in section of the embodiment of FIG. 5.

FIG. 5 shows another type of coin sorter of a type shown and described in U.S. Pat. No. 5,507,379, issued Apr. 16, 1996. In this sorter, coins are dropped through a central opening 42 into an annular sorting head 43 in which the coins are deposited on a resilient pad 44 carried by a rotatable disc 45 (FIG. 6). As the disc 45 is rotated, coins are carried in a gap 46 between the upper surface of the pad 44 and the lower surface of the sorting head 43. The coins are directed through various recesses on the bottom of the sorting head 43 and then sorting channels 47 also formed on the bottom of sorting head 43. The sorting channels 47 are sized to select and sort the coins by denomination.

The sorting channels 47 open towards respective guide members 48, which curve downwardly to direct the coins to respective coin tubes 20*a* of the present invention. The coin tubes 20*a* are similar to coin tubes 20 shown in FIG. 1. The upper ends 21*a* of the coin tubes 20*a* encircle the flanges 19*a* (FIG. 6) depending from a support member 16*a*. The upper ends 21*a* have a groove 31*a* in which three apertures 32*a* are provided for alignment with three apertures 33*a* in the flange 19*a*. Pins 34*a* are inserted in the apertures 32*a*, 33*a* in three locations angularly spaced 120 degrees around the upper portion 21*a* of the tube 20*a*. An O-ring 35*a* of resilient, synthetic or natural rubber material is placed in the groove to cover the heads of the pins 34*a* and retain them in place. Other well known methods of attachment can also be used.

As another example of attachment in a coin processing machine, FIG. 7 illustrates a support member 16*b* of a type shown and described in U.S. Pat. No. 5,297,598, issued Mar. 29, 1994, in which a coin tube 20*b* has an upper end 21*b* with a lip that slides on a ledge 23*b* running along the bottom periphery of an opening in the support member 16*b*. In this embodiment, coin tubes 20*b* of the type described for FIGS. 1, 2, and 6 are modified so that the ledge 23*b* entering from outside the periphery of the coin tube 20*b* is received into a groove or area underneath the lip of the upper end 21*b* of the coin tube 20*b*. There is not, therefore, a need for the pins and the O-ring of the embodiments described previously.

In other respects the coin tubes 20*a* and 20*b* are constructed as coin tube 20 including a cylindrical end upper portion, a tapering cylindrical neck portion, a cylindrical holder portion of constant diameter for receiving an upper end of a cylindrical paper or plastic coin wrapper, and a bottom cylindrical flared portion with an open end in which a U-shaped clip or bail is pivotably mounted.

Referring again to FIGS. 1–4, in operation, a plurality of coin tubes 20 are attached to coin chutes 16 of a coin sorting machine 10. The coin wrappers 24 are supported in each coin tube 20 against falling out of a bottom end of each coin tube, by pivoting the bail member 26 to open the lower end of the tube 20, inserting the coin wrapper 24, and then pivoting the bail member 26 back to a closed position under the wrapper 24 with the projection being received in an open lower end of the wrapper 24. With the wrappers 24 in position, a batch of coins is sorted with the coins passing through respective sorting openings within the sorting machine 10 and into the wrappers 24. The coin wrappers can then be removed from the coin tubes 20 by pivoting the bail members 26. The upper ends of the wrappers 24 are then either folded or crimped to close them.

From the above description it can be seen that there are various modifications that can be made for attachment of coin tubes to various types of coin handling equipment of the type having exits for multiple denominations. While the preferred embodiments show attachments to rotary coin sorters, the invention may be practiced with other types of equipment such as rail sorters.

And while the coin tubes of the present invention have an open lower end and pivotable member for supporting the wrappers, it should be apparent that an equivalent structure is a close-ended coin tube with a quick attachment/detachment construction at the upper end. These equivalent embodiments are considered to be within the broadest scope of the present invention.

This has been a description of the preferred embodiments of the method and apparatus of the present invention. Those of ordinary skill in this art will recognize that still other modifications might be made while still coming within the spirit and scope of the invention and, therefore, to define the embodiments of the invention, the following claims are made.

We claim:

1. An accessory kit for a coin sorter, comprising:

a plurality of coin tubes for holding coin wrappers for respective denominations in a substantially upright position for receiving coins of respective denominations that exit a coin sorter;

said coin tubes having openings at lower ends for receiving coin wrappers inserted from the lower ends;

said coin tubes also having supports at said lower ends for supporting the coin wrappers in the coin tubes without requiring continuing manual assistance by a user; and wherein said coin tubes each include a portion for individual mounting to a respective exit on said coin sorter for receiving coins of a respective denomination that exit the coin sorter.

2. The kit of claim 1, wherein the supports allow orienting the coin wrappers and the respective supports at an angle relative to each other to permit sliding of the coin wrappers loaded with coins from the lower ends of said coin tubes.

3. The kit of claim 1, wherein the coin tubes each have an upper end with a side wall, and further comprising pins that extend through the side wall at the upper end of a respective one of the coin tubes and into a flange of a respective one of a plurality of coin chutes on the coin sorter.

4. The kit of claim 1, wherein the coin tubes each have a lip that is retained by a portion of the coin sorter.

5. The kit of claim 1, wherein each of the supports is a U-shaped member pivotably mounted to a lower portion of a respective one of said plurality of coin tubes for supporting a lower end of a respective coin wrapper as coins are loaded into said coin wrapper.

6. The kit of claim 1, wherein each U-shaped member has a cross piece with a projection positioned to project upward into an end of a coin wrapper.

7. The kit of claim 1, wherein the upper portion of each coin tube includes an upper end with a side wall with a groove and with holes positioned in the groove and spaced 120 degrees around a circumference of said upper end, and said kit further comprising pins that extend through the holes into a flange on the coin sorter, and further comprising a resilient circular member for placement in the groove for retaining the pins in the holes.

8. The kit of claim 1, wherein the plurality of coin tubes includes at least five coin tubes.

* * * * *